United States Patent [19]

Stewart et al.

[11] Patent Number: 4,567,905

[45] **Date of Patent: * Feb. 4, 1986**

[54] ACTUATOR CONTROL FOR RETRACTABLE BRISTLE BRUSHES

[75] Inventors: James B. Stewart, Randolph, N.J.; Edward J. Doyle, Hatboro, Pa.

[73] Assignee: Conair Corporation, Edison, N.J.

[ * ] Notice: The portion of the term of this patent subsequent to Aug. 28, 2001 has been disclaimed.

[21] Appl. No.: 678,275

[22] Filed: Dec. 5, 1984

Related U.S. Application Data

[63] Continuation of Ser. No. 538,145, Oct. 3, 1983, abandoned, which is a continuation-in-part of Ser. No. 511,632, Jul. 7, 1983, Pat. No. 4,467,821.

[51] Int. Cl.[4] ..... A45D 2/00

[52] U.S. Cl. ..... 132/40; 132/37 R; 132/33 R

[58] Field of Search ..... 132/40, 33 R, 37 R

[56] References Cited

U.S. PATENT DOCUMENTS 4,473,086 9/1984 Thaler ..... 132/37 R

*Primary Examiner*—Gregory E. McNeill

*Attorney, Agent, or Firm*—Haynes N. Johnson

[57] ABSTRACT

A slideable control is provided for use in retractable bristle brushes. It operates by co-action with a rotatable, cylindrical mandrel carrying pivoted bristles and having an angular cam slot. The control includes a longitudinally slideable button in the handle which has a control pin operatively extending through a control slot in the handle and then into the cam slot to cause rotation of the mandrel. The angular cam slot includes an axial portion at each end to receive the control pin and to lock the mandrel in a position with the bristles either fully retracted or fully extended. The control button includes a pair of parallel guide blades, one on each side of the control pin, slideable within slotted guides in the handle, to reduce torque between the control pin and the cam slot. The control slot may include detents proximate to its ends to receive and hold the control pin against longitudinal movement.

3 Claims, 10 Drawing Figures

ACTUATOR CONTROL FOR RETRACTABLE BRISTLE BRUSHES

This application is a continuation of application Ser. No. 538,145, filed Oct. 3, 1983, now abandoned, which is a continuation-in-part of Ser. No. 511,632, filed July 7, 1983 now U.S. Pat. No. 4,467,821.

BACKGROUND OF THE INVENTION

Hair-curling brushes having retractable bristles or teeth are used to permit ready removal of the brush from curled hair, by retracting the bristles into the barrel of the device. Examples are shown by Kay U.S. Pat. No. 2,244,068, Lerner U.S. Pat. No. 2,803,256 and Bertschi U.S. Pat. No. 4,327,753.

One method of retracting the bristles is to have an inner mandrel carrying pivotally-mounted bristles or teeth which project through openings in an outer barrel or sleeve. Rotation of the mandrel relative to the barrel causes the bristles to move in and out, as disclosed in Kay (FIGS. 8–11 and Bertschi.

For simplified operation, however, it is desirable to have a longitudinally slideable actuating control button in the handle to cause the bristles to project or retract.

SUMMARY OF THE INVENTION

This invention relates to a hair-curling device with retractable teeth or bristles of the general nature described in the above-mentioned patents.

For ease of operation, however, control of bristle retraction and projection is through a longitudinally-slideable button in the handle, permitting simple, one-hand operation.

The button carries a control pin on its inner side which passes through a control slot in the handle and travels within an angular (non-longitudinal) cam slot in the inner end of the rotatable mandrel. Thus, longitudinal movement of the control pin causes rotation of the mandrel and, so, causes the bristles to retract or project.

The bristles may be more securely held in their retracted or projected position if the two ends of the control slot are extended in a longitudinal, axial direction to receive the control pin at the end of its longitudinal stroke. This extension minimizes the likelihood that pressure on the bristles can cause the mandrel to rotate.

The button and control pin can cause sidewise torque on the control pin and, so, sidewise torque and friction on the button. This can be reduced by using a pair of parallel blades attached to the underside of the button, one on each side of the control pin, which move within parallel slotted guides running longitudinally of the handle.

The control slot may include "lock" positions near each end. These locking positions are formed by slightly enlarging the control slot near each end to create a detent to hold the control pin. This detent serves to keep the control pin in place and so to keep the bristles or teeth in either their projecting or retracted position.

DETAILED DESCRIPTION OF THE INVENTION

Figure 1:
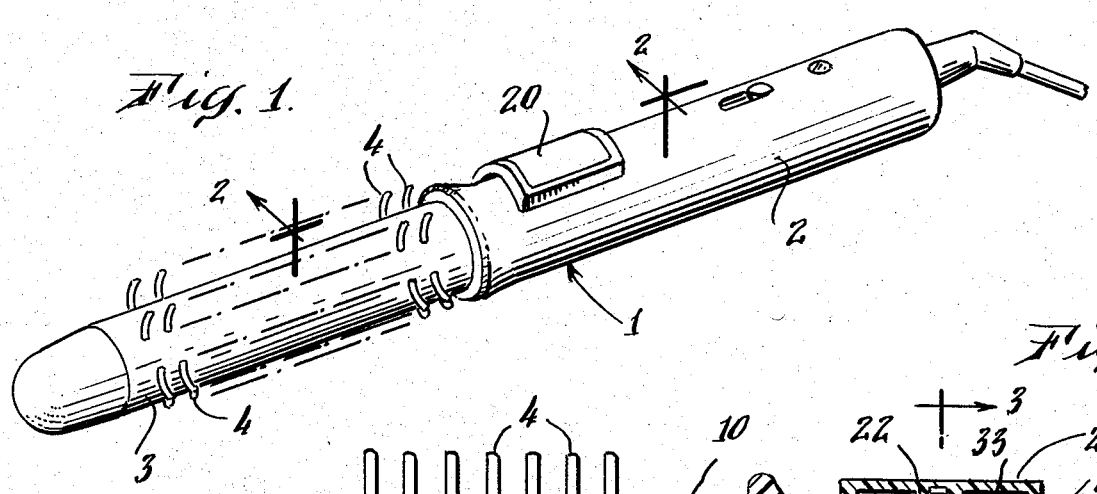
FIG. 1 is a perspective view of a brush of the type incorporating my invention.
Figure 2:
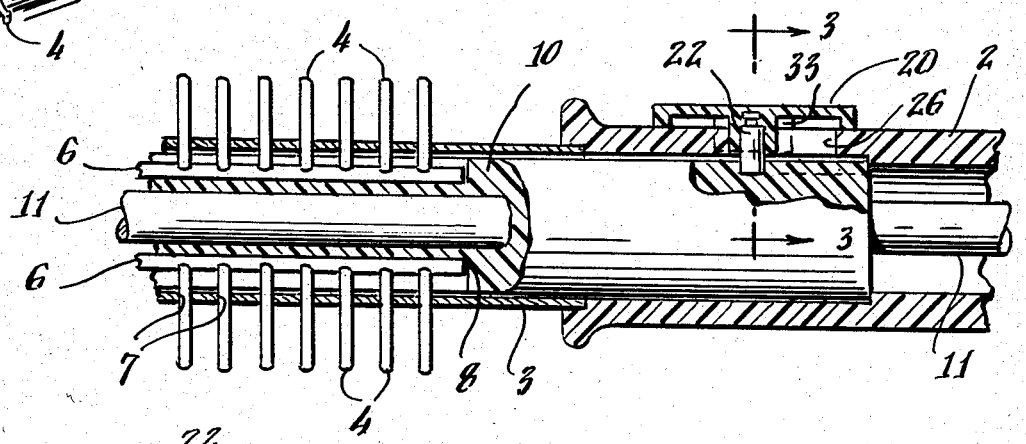
FIG. 2 is a partial side view section on line 2—2 of FIG. 1 showing the rotatable mandrel, control pin and retractable teeth.
Figure 3:
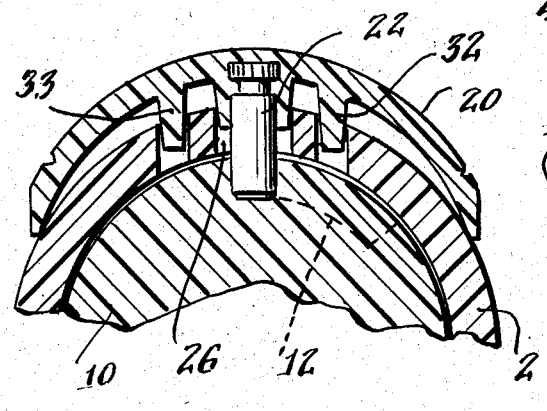
FIG. 3 is a partial section on line 3—3 of FIG. 2 showing the control button, pin and guiding blades.

FIG. 1 shows a retractable bristle brush 1 of the general type embodying my invention. It includes a handle 2, a barrel or sleeve 3 mounted in handle 2, and retractable bristles or teeth 4. In one design teeth 4 have been molded on pivot rods 6. The rods rest in longitudinal slots 8 in cylindrical mandrels 10 with teeth 4 projecting through holes 7 in barrel 3. Mandrel 10 is rotatable with respect to barrel 3, and its rotation causes pivot rod 6 to rotate, retracting teeth or bristles 4 (see, for example the Bertschi patent). Mandrel 10 may, if desired, enclose an electrical heating element 11.

Retraction and projection of the bristles is simplified for the user, as in the present invention, when sleeve 3 is fixed in handle 2 and cannot rotate with respect to the handle; and mandrel 10 is rotatably mounted in handle 2 and is made to rotate by longitudinal sliding motion of a button 20 mounted on handle 2. This is accomplished by using a control pin 22 secured to button 20 which coacts with an angular cam slot 12 in the portion of mandrel 10 that is within handle 2.

More specifically, control button 20 has a metal control pin 22 molded or otherwise secured to it in its center. Pin 22 is directed radially inwardly through a control slot 26 in the handle 2. (Slot 26 is longitudinal with respect to the handle.) Mandrel 10 has a corresponding angular cam slot 12 located below control slot 26; and control pin 22 projects through control slot 26 and into cam slot 12. Slot 12 is at such an angle to the axis that movement of control pin 22 from one end to the other of control slot 26 will cause mandrel 10 to rotate the proper amounts to cause teeth 4 either to fully project from, or be fully retracted into, barrel 3.

Figure 4:
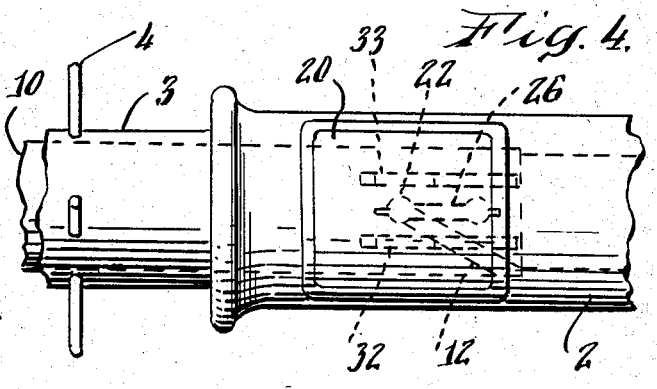
FIG. 4 is a partial top plan view of the control button, showing its operation.
Figure 5:
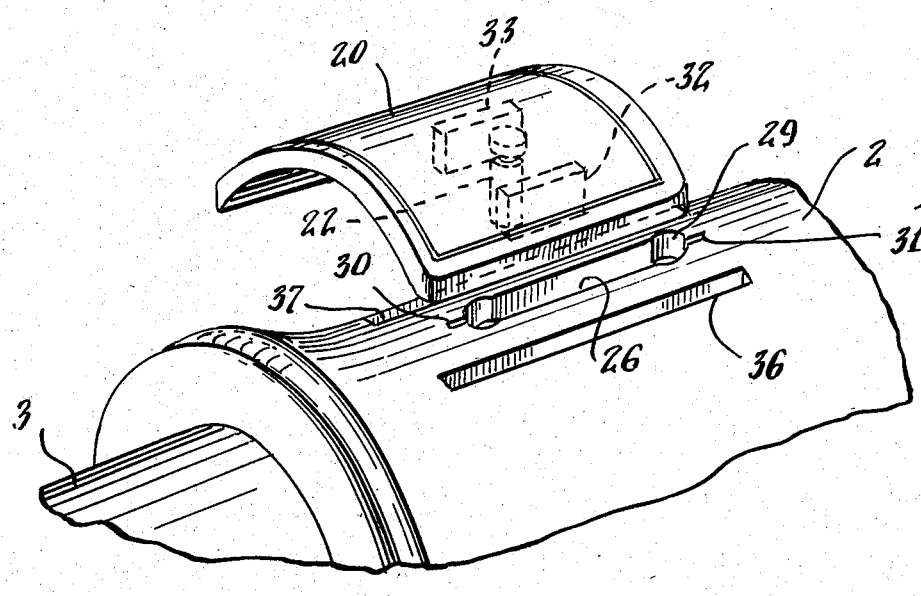
FIG. 5 is an exploded perspective view of the control button and a portion of the handle.
Figure 7:
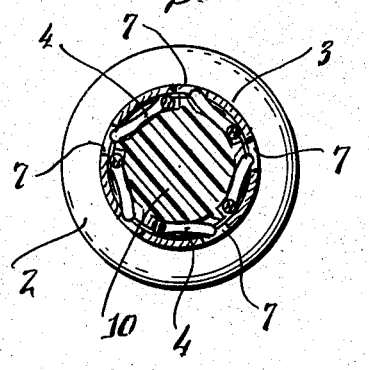
FIG. 7 is a sectional view on line 7—7 of FIG. 6 showing the retracted bristles.
Figure 6:
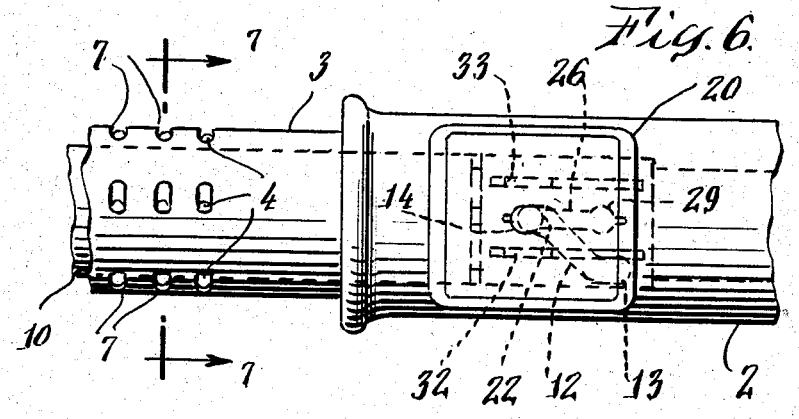
FIG. 6 is a partial top plan view similar to FIG. 4, but showing a modification in which the cam slot includes an longitudinal, axial portion at each end to act as a lock. The bristles are shown retracted.
Figure 9:
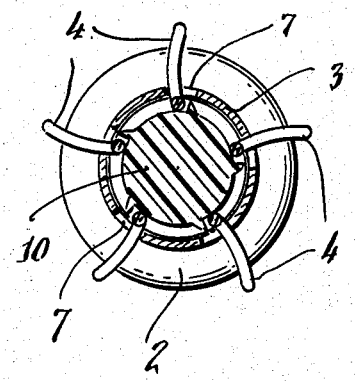
FIG. 9 is a section on 9—9 of FIG. 8 showing the bristles extended.
Figure 8:
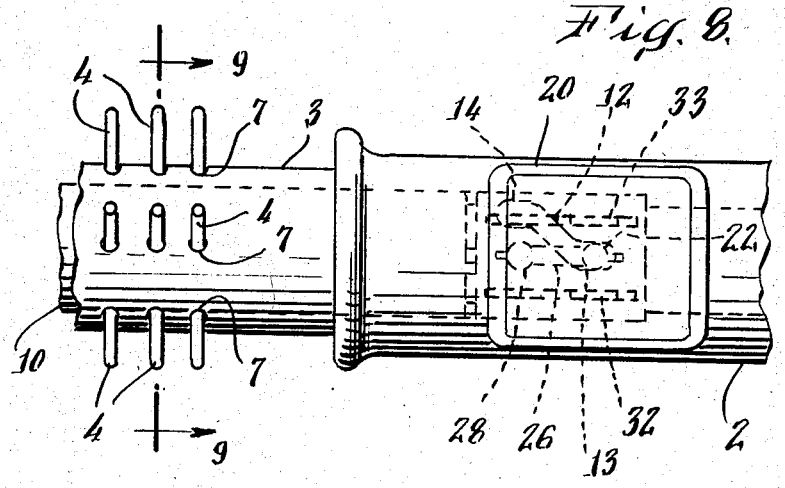
FIG. 8 is similar to FIG. 6 except the bristles are extended.
Figure 10:
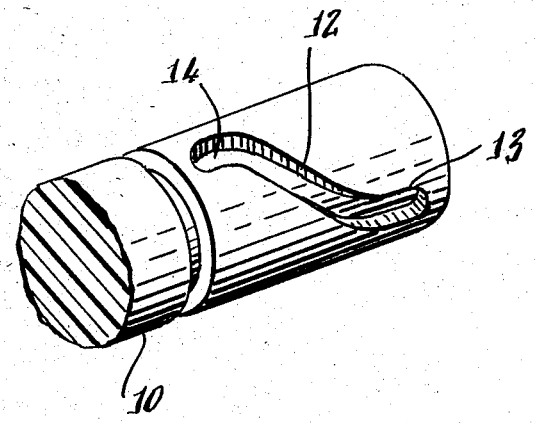
FIG. 10 is a perspective view of a portion of the mandrel showing the cam slot with the longitudinal axial extensions at each end.

Control slot 26 is preferably designed with "lock" positions near each end, to hold bristles 4 in either the retracted or projected position. This is accomplished by having wider areas such as detents 28 and 29 proximate to the ends of slot 26 (FIGS. 4 and 5) and having the width of slot 26 such as to give a tight fit to pin 22. This will cause pin 26 to tend to remain at the end positions of detents 28 and 29. More resiliency is provided for flexing of the plastic of handle 2 about slot 26 during pin movement if slot 26 has short slits 30 and 31 at its ends, beyond and outside detents 28 and 29, respectively.

The relationship between control pin 22 and angular cam slot 12 may result in some undesirable sidewise torque during use. This can be reduced by the use of one or more, preferably two, parallel guide blades 32 and 33 on the inside of button 20 on opposite sides of pin 22. These slide within parallel guide slots 36 and 37 in handle 2, one on each side of control slot 26. The blades and guide slots should run longitudinally of handle 2; and the guide slots 36 and 37 should be long enough relative to the length of blades 32 and 33 to permit control pin 22 to move the full length of control slot 26.

In use, button 22 is moved in the direction that causes control pin 22 to move in cam slot 12 in a direction that will rotate mandrel 10 in the direction that causes teeth or bristles 4 to project. Pin 22 will then be held in its respective detent 28 or 29. Hair is then curled about barrel or sleeve 3 and allowed to set. After it has set, button 20 is pressed in the opposite direction, reversing the rotation of mandrel 10 and causing teeth 4 to retract. Barrel 3 may then be removed from the curled hair by being moved longitudinally.

A preferred modification of this structure is shown in FIGS. 6 through 10. The essential difference between this and the prior structure is that cam slot 12 in mandrel 10 is extended in a longitudinal, axial direction at each end as shown by extensions 13 and 14. As a result, when slideable control button 20 is moved to the retracted position, as in FIG. 6, or to the bristle-extended position as in FIG. 8, control pin 22 continues beyond the angular portion 12 of the control slot into axial portion 14 or axial portion 13 respectively. This does not cause further motion of the bristles but it does mean that any pressure on the bristles or rotary pressure on the mandrel will be resisted. Thus, for example, referring to FIGS. 8 and 9, were there to be pressure on bristles 4, mandrel 10 would not rotate because it would be held against rotation by the fact that control pin 22 was positioned within slot extension 13, locking mandrel 10 against rotation. Similarly, in FIG. 6, pin 22 is in extension 14, again preventing rotation of mandrel 10. By contrast, it can be seen in FIG. 4 that pressure on bristles 4, tending to rotate mandrel 10, could simply force pin 22 to move within angular slot 12, since it is possible that the resistive force of the locking detents 28 and 29 could be overcome. Use of extensions 13 and 14 may make it unnecessary to use detents 28 and 29.

I claim:

1. A retractable bristle hair curling brush adapted for simple, one-handed control of projection and withdrawal of bristles, said brush including, a handle having an axially-projecting cylindrical barrel, said barrel including a plurality of openings thereon on said barrel surface, a cylindrical mandrel rotatably mounted within said handle and extending within said barrel, pivotally mounted bristles on said mandrel adapted to extend radially through said openings or retract to a position within said barrel depending upon the relative rotational positions of said barrel and said mandrel, said mandrel including a cam slot in the portion thereof within said handle, a slideable control button mounted on said handle above said cam slot for longitudinal movement relative to said handle and a control pin extending inwardly from said control button through said control slot into said cam slot, said cam slot having an angular portion and a longitudinal axial extension on at least one end thereof, whereby longitudinal motion of said control button serves to move said control pin within said slot and to rotate said mandrel relative to said barrel when said control pin is in the angular portion of said slot and to lock said mandrel against motion relative to said barrel when said control pin is in said extension of said cam slot.

2. A brush as set forth in claim 1 in which said cam slot has said longitudinal, axial extensions at each end thereof.

3. A brush as set forth in claim 2 in which said control slot includes flexing locking detents proximate to at least one end thereof said detents being axially aligned with said slot.

* * * * *